United States Patent [19]

Yuhara et al.

[11] Patent Number: 4,679,576

[45] Date of Patent: Jul. 14, 1987

[54] VANITY CASE

[75] Inventors: Yukitomo Yuhara, Abiko; Sumio Okojima, Yachiyo; Tatsuo Ishikawa, Chiba, all of Japan

[73] Assignee: Yoshida Industry Co., Ltd., Tokyo, Japan

[21] Appl. No.: 743,963

[22] Filed: Jun. 12, 1985

[30] Foreign Application Priority Data

| | | | |
|---|---|---|---|
| Mar. 15, 1985 | [JP] | Japan | 60-36093[U] |
| Mar. 25, 1985 | [JP] | Japan | 60-41521[U] |
| Mar. 28, 1985 | [JP] | Japan | 60-43956[U] |
| Mar. 28, 1985 | [JP] | Japan | 60-43955[U] |
| Mar. 28, 1985 | [JP] | Japan | 60-43954[U] |
| Apr. 5, 1985 | [JP] | Japan | 60-49989[U] |

[51] Int. Cl.[4] ..... A45D 33/00

[52] U.S. Cl. ..... 132/82 R; 132/83 R

[58] Field of Search ..... 132/79 R, 79 F, 79 G, 132/82 R, 83 R, 83 D; 292/DIG. 37, 83, 85, 86

[56] References Cited

U.S. PATENT DOCUMENTS

| | | | |
|---|---|---|---|
| 1,794,339 | 2/1931 | Noble | 132/83 R |
| 2,035,831 | 3/1936 | Parkin | 132/83 R |
| 2,734,517 | 2/1956 | Ferraro | 132/83 R |
| 4,276,893 | 7/1981 | Enomoto et al. | 132/83 R |
| 4,366,829 | 1/1983 | Yuhara | 132/83 R |
| 4,387,730 | 6/1983 | Shioi | 132/83 R |
| 4,392,503 | 7/1983 | Watanabe | 132/83 R |
| 4,399,826 | 8/1983 | Ogasawara | 132/83 R |

FOREIGN PATENT DOCUMENTS

| | | | |
|---|---|---|---|
| 2338671 | 8/1977 | France | 132/83 R |
| 2471326 | 6/1981 | France | 132/79 R |
| 2534747 | 4/1984 | France | 132/83 R |

*Primary Examiner*—Robert Peshock
*Assistant Examiner*—Cary E. Stone
*Attorney, Agent, or Firm*—Wenderoth, Lind & Ponack

[57] ABSTRACT

A vanity case includes a receptacle and a cover hinged with each other at rear ends thereof, the cover being maintained in a closed position by engagement between latch tongues formed on the receptacle and the cover. The receptacle is formed at the front end with a recess within which is slidably disposed a push piece having a front wall and an arm integrally formed with the front wall through a thin flexible section which permits the arm to tilt relative to the front wall. The upper end of the arm is positioned closely adjacent the lower surface of the cover, and the rear end of the arm abuts against the inner wall defining the recess and, upon rearward movement of the push piece, slides on the inner wall upwardly to tilt the arm whereby the upper end of the arm forces the cover in upward and forward directions to release the engagement of the latch tongues.

20 Claims, 18 Drawing Figures

VANITY CASE

BACKGROUND OF THE INVENTION

The present invention relates to a vanity case for use with make-up or the like. More particularly, this invention relates to an improvement of a vanity case of a type in which a receptacle member and a cover member are hinged together at the rear ends thereof and are arranged to be latched by snap engagement between a first latch tongue of the cover and a second latch tongue formed on an inner wall defining a recess which is formed in the front end of the receptacle to receive a push piece. The push piece is movable in the recess and is adapted to, upon rearward movement thereof, produce a force which urges the cover upwardly so as to release the engagement of the latch tongues.

A vanity case of the type set forth above is disclosed in, for example, U.S. Pat. No. 4,276,893 wherein the push piece is molded of relatively hard plastic material and includes an inner end portion and an enlarged outer end portion to form an inclined surface therebetween, the surface being inclined upwardly toward the outer end and abutting a lower end of a nose having the first latch tongue and extending from the lower surface of the cover when the latter is in a closed position with respect to the receptacle. Thus, pressing the push piece inwardly causes the nose to slide on the inclined surface, thereby urging the nose upwardly to open the cover.

In the above vanity case, however, the force acting on the nose has a direction perpendicular to the inclined surface and therefore includes a component of force in a horizontal direction, which component tends to urge the nose toward the nner wall of the recess where the second latch tongue is formed. It thus will be understood that a user would have to press the push piece with a relatively large force in order to open the cover since the component in the horizontal direction tends to strengthen the engagement between the first and second latch tongues. This is not desirable in view of nature of the vanity case.

SUMMARY OF THE INVENTION

It is therefore an object of the present invention to provide a vanity case of the type set forth above in which a push piece, upon rearward movement thereof, exerts on a cover member such a force as to urge the cover member both in upward and forward directions, thereby releasing engagement between a first latch tongue and a second latch tongue with a relatively small force as compared with the known arrangements.

Another object of the present invention is to provide a vanity case including a push piece which may be a one-piece mold to thereby permit the vanity case to be manufactured and assembled easily.

A further object of the present invention is the provision of a vanity case in which a push piece, upon removal of pressure applied thereto, may automatically return to its normal position and be held thereat whereby the push piece is prevented from clattering within a recess after a cover member is opened with respect to a receptacle member.

According to the present invention, a vanity case comprises a receptacle member molded of plastic material for containing cosmetic material, a cover member also molded of plastic material and hinged with the receptacle member at the rear ends thereof, a recess formed in a front end of the receptacle member and defined by an inner wall, a bottom surface and side walls, a first latch tongue formed on the cover member, and a second latch tongue formed on the inner wall of the recess, the first and second latch tongues being engaged with each other by snap action when the receptacle member is closed by the cover member to thereby maintain the cover member in a closed position with respect to the receptacle member. Disposed within the recess is a push piece which is movable therein backwardly and forwardly and which has a front wall and an arm integrally formed with the front wall through a thin flexible section, the flexible section permitting the arm to tilt with respect to the front wall, An upper end of the arm is positioned closely adjacent a lower surface of the cover member in the closed position of the cover member, and the rear end of the arm is in contact with the inner wall of the recess and, upon rearward movement of the push piece, slides on the inner wall upwardly to tilt the arm whereby the upper end of the arm forces the lower surface of the cover member in upward and forward directions to release engagement between the latch tongues.

The arm may have a substantially rectangular shape and may be normally inclined upwardly toward the rear end thereof with the flexible section being in a bent status. The upper end of the arm preferably includes a surface so inclined relative to the longitudinal axis of the arm as to extend parallel to the lower surface of the cover member. The arm may include a rounded front end which rests against a corner defined between the front wall of the push piece and either the bottom surface of the recess or a bottom wall integrally formed with the front wall to extend perpendicularly thereto.

Alternatively, the arm may comprise a head piece having a rounded front end which abuts against the inner surface of the front wall, and the inner wall of the recess may include a shelf with which the rear end of the head piece is in contact, at least one of the shelf and the rear end of the arm having a slanted surface adapted to cause the rear end to slide on the shelf upwardly by the rearward movement of the push piece. Still alternatively, the arm may comprise a triangular piece having a front end integrally joined with the flexible section extending from the end surface of a bottom wall of the push piece.

In some of the embodiments of the present invention, the push piece further comprises a pair of guide arms extending rearwardly from opposite sides of the lower end of the front wall, and the recess in the receptacle member includes a pair of guide holes formed in the lower end of the inner wall for receiving the end portions of the guide arms therein. The guide arm may have formed on the lower surface thereof a projection slidably engaged with a groove formed in the bottom surface of the recess.

In any of the embodiments of the invention, it is preferable that the lower surface of the cover member includes a projection on which the first latch tongue is formed, the upper end of the arm being closely adjacent the lower end of the projection in the closed position of the cover member.

Other objects, features and advantages of the present invention will be apparent from the following detailed description of preferred embodiments thereof when taken in conjunction with the accompanying drawings, in which:

DETAILED DESCRIPTION OF THE INVENTION

Figure 1:
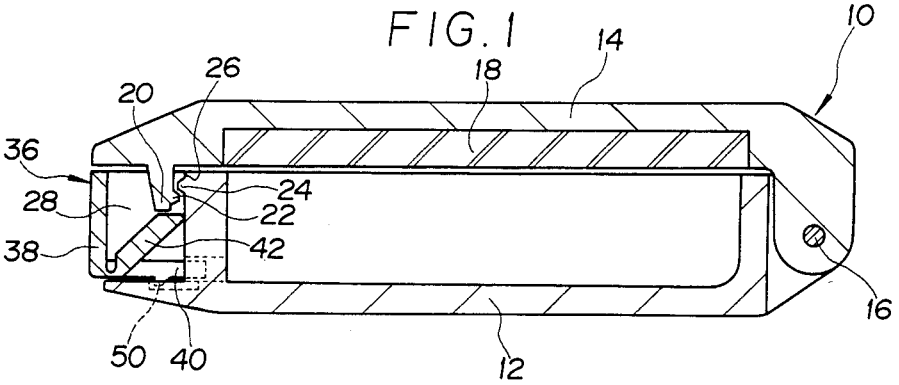
FIG. 1 is a sectional view showing a vanity case according to a first embodiment of the present invention.
Figure 2:
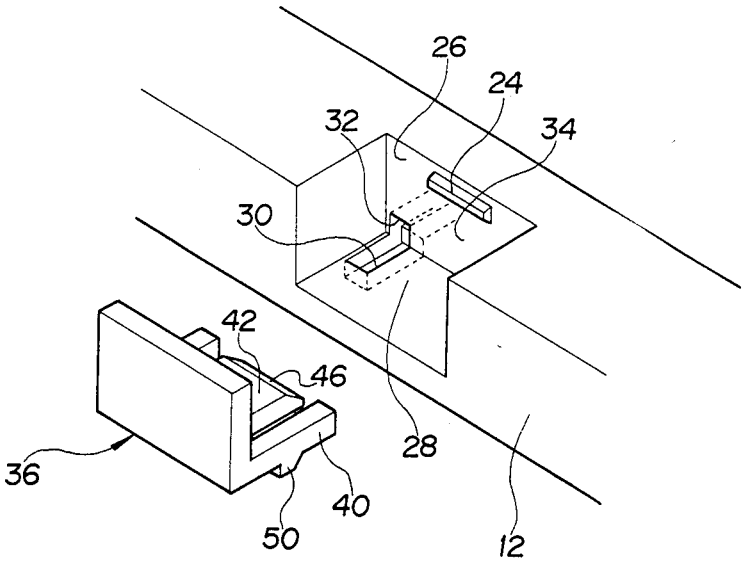
FIG. 2 is a fragmentary perspective view illustrating a recess and a push piece of the vanity case in FIG. 1.

Referring to FIGS. 1 to 5 of the drawings, there is illustrated a vanity case according to a first embodiment of the invention. The vanity case generally designated by numeral 10 includes a receptacle member 12 adapted to receive therein a cosmetic material or the like and molded of plastic material, and a cover member 14 also molded of plastic material and hinged with the receptacle 12 at respective rear ends through a pin 16. Attached to the inner surface of the cover 14 is a mirror 18 for convenience in using the make-up. A projection 20 extends downwardly from the front end of the cover 14 and is provided with a first latch tongue 22 which projects rearwardly to engage with a second latch tongue 24 formed on an inner wall 26 of the receptacle 12. The inner wall 26 defines a box-like recess 28 formed in the central portion of the front end of receptacle 12 for permitting the projection 20 to extend therein. The cover 14 is maintained in a closed position with respect to the receptacle 12 by snap engagement between the first and second latch tongues 22 and 24.

The recess 28 is also defined by a bottom surface in which are formed a pair of grooves 30 positioned adjacently to side walls that also define the recess. The lower end of the inner wall 26 is excavated at positions corresponding to the grooves 30 to provide a pair of guide holes 32. Between the guide holes 32 and the second latch tongue 22 the inner wall 26 forms a smooth vertical surface 34 for a purpose described hereinafter.

Figure 3:
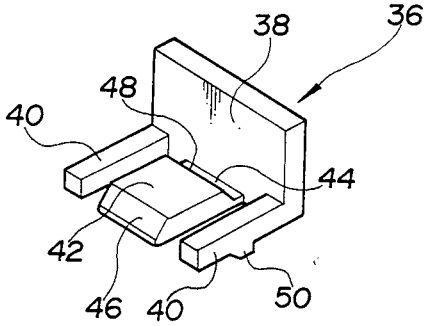
FIG. 3 is a perspective view of the push piece in FIG. 2.

Disposed within the recess 28 is a push piece 36 adapted to function as a releasing member for the latch tongues 22 and 24. The push piece 36 is a one-piece mold of plastic material and, as best shown in FIG. 3, comprises a vertical front wall 38, a pair of guide arms 40 extending rearwardly from the lower end of the wall 38 at opposite sides thereof, and a tilt arm 42 disposed between the pair of guide arms 40 and integrally connected to the lower end of the wall 38 by means of a flexible section 44. The section 44 is formed so thin that it permits the arm 42 to be tilted relative to a plane perpendicular to the wall 38. The arm 42 is in the shape of a rectangle having an outer or rear slated surface 46 and an inner or front slanted surface 48 the lower edge of which is integral with the section 44. A hook-like projection 50 is provided on the lower side of each guide arm 40 is slidably engage with the groove 30 of the receptacle 12.

In order to mount the push piece 36 in the recess 28, after the arm 42 in manually tilted by bending the section 44 upwardly, the guide arms 40 are forcedly inserted into the holes 32 while engaging the projections 50 with the grooves 30. The push piece 36 thus mounted in the recess 28 is movable therein toward and away from the inner wall 26 and is retained therein by the engagement of the projections 50 with the grooves 30.

Figure 4:
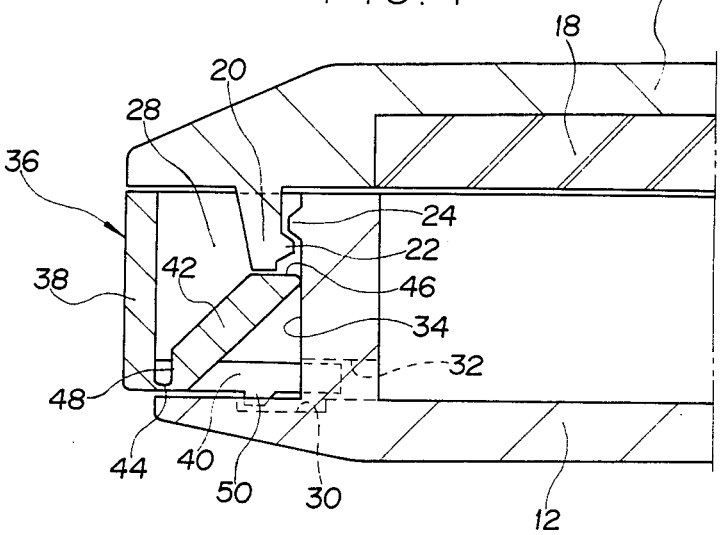
FIG. 4 is an enlarged sectional view of the vanity case in FIG. 1, with the push piece being in a normal position.

As shown in FIGS. 1 and 4, the rear edge of the tilt arm 42 is in contact with the vertical surface 34 of the inner wall 26, defining an acute angle between the surface 34 and the lower side of the arm 42. Due to the tilt of the arm 42 the upper surface 46 becomes substantially flat, that is, parallel to the bottom of recess 28, and is closely adjacent to the lower end of the projection 20 when the cover 14 is in the closed position. If desired, the projection 20 may be so designed as to touch the upper surface 46 even when the push piece 36 is in the normal position shown in FIG. 1. The front surface 48 of arm 42 becomes substantially vertical and is adjacent to the wall 38.

Figure 5:
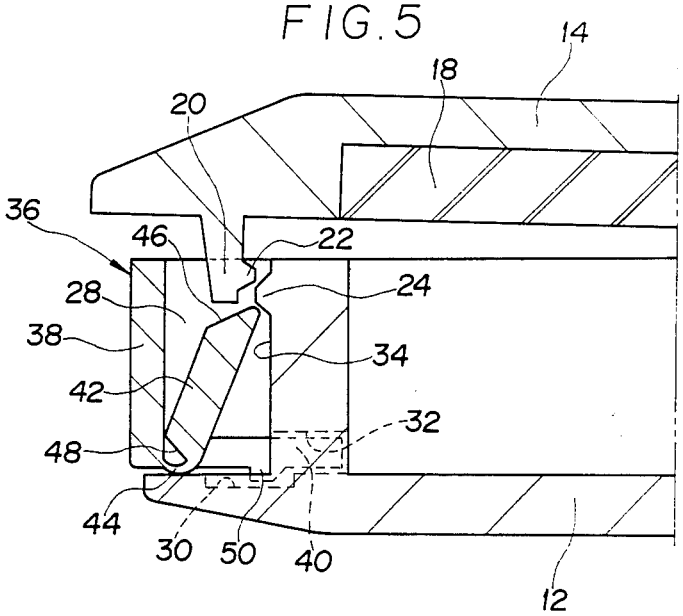
FIG. 5 is also an enlarged sectional view of the vanity case showing the push piece in an active position.

Assuming now that the cover 14 is closed over the receptacle 12 as shown in FIG. 4, when the vertical wall 38 is forced to move rearwardly, the arm 42, is restrained from movement in such direction due to the contact of its rear edge with the vertical surface 34, and thus is further tilted with its rear edge sliding upwardly along the surface 34 and with further bending of the flexible section 44. This upward displacement of the rear edge of arm 42 results in a contact of the surface 46 with the lower inner edge of the projection 20 to press the latter upwardly and forwardly whereby the second latch tongue 24 is disengaged from the first latch tongue 22 and the cover 14 is opened with respect to the receptacle 12, as shown in FIG. 5. Thereafter, upon removal of the pressure applied to the wall 38, the push piece 36 is returned to the normal position of FIG. 4 by the flexibility or elasticity of the section 44, thus preventing the push piece from clattering in the recess 28.

It is to be noted here that the disengagement of the first latch tongue 22 from the second one 24 can be achieved with relatively small force because the tilt arm 42 presses the projection 20 not only in the upward direction but also in the forward direction such that the engagement between latch tongues is weakened. The push piece 36 is a one-piece mold as mentioned above and may be formed by injection molding by using a simple die to reduce manufacturing costs. Also, assembly can be carried out easily by mounting the single piece 36 in the recess 28.

In the above embodiment the arm 42, upon inward or rearward movement of the push piece 36, acts on the projection 20 of the cover 14. It is possible within the scope of the present invention to have the tilt arm act on other portions of the lower surface of the cover 14.

Figure 6:
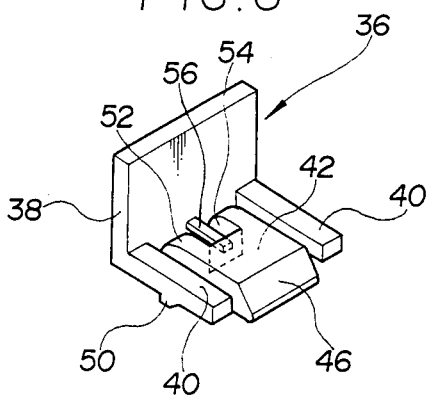
FIG. 6 is a perspective view of a push piece according to a second embodiment of the present invention.
Figure 7:
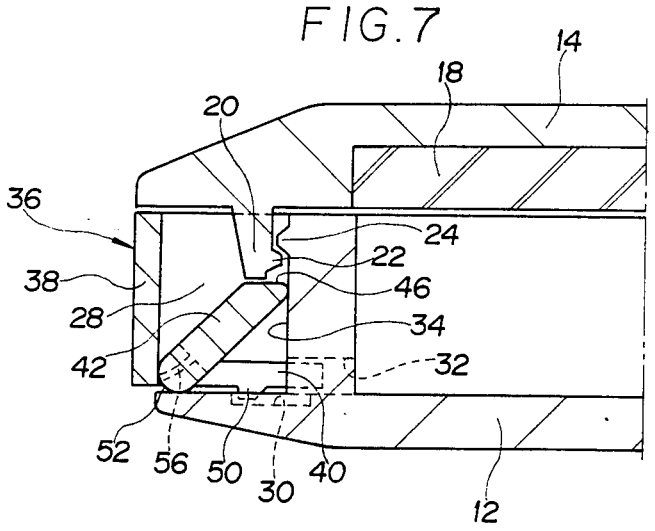
FIG. 7 is a fragmentary sectional view of a vanity case incorporating the push piece of FIG. 6.

FIGS. 6 and 7 illustrate a second embodiment of the invention wherein the tilt arm 42 of the push piece 36 has a rounded inner end 52 recessed at 54 recessed at 54 into which a thin, flexible piece 56 extends to integrally connect the arm 42 to the vertical wall 38. When the push piece 36 is mounted in the recess 28 after the arm 42 is tilted by bending the flexible piece 56, the rounded end 52 rests against a corner defined between the lower end of the wall 38 and bottom of the recess 28 as shown in FIG. 7. It will be understood that pushing the wall 38 inwardly causes the rounded end 52 to move in the same direction whereby the rear edge of the arm 42 slides on the surface 34 upwardly to press the projection 20 as in the first embodiment. Other structures and features of the second embodiment are the same as those of the first embodiment and therefore further description is omitted.

Figure 8:
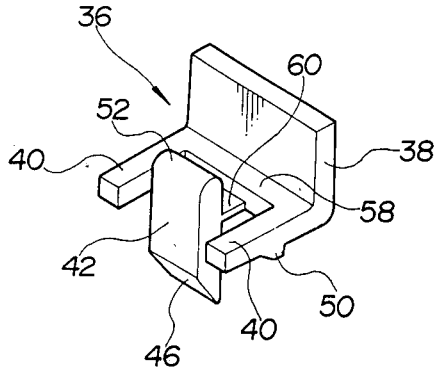
FIG. 8 is a perspective view illustrating a push piece according to a third embodiment of the present invention.
Figure 9:
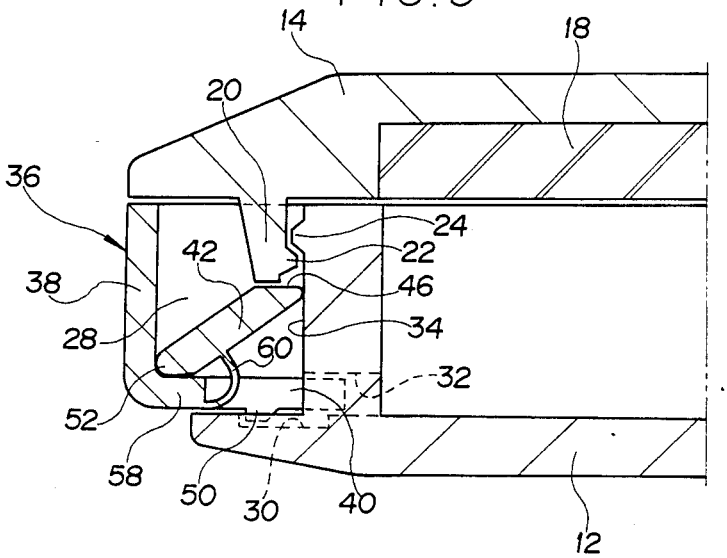
FIG. 9 is a view similar to FIG. 7 with the push piece of FIG. 8.

In the third embodiment of the invention illustrated in FIGS. 8 and 9, the push piece 36 includes a bottom wall 58 extending perpendicularly to the wall 38 by a distance sufficiently small to define a hollow space in cooperation with the pair of guide arms 40. From the end of the bottom wall 58 extends a thin, flexible section 60 having an outer end integrally connected to the arm 42. The arm 42 is formed to extend perpendicularly relative to the section 60 which terminates at the inner side of the arm 42 between the rounded end 52 and the tapered end having the slanted surface 46. In assembly, the section 60 is upwardly bent so that the arm 42 is held in the tilted position where the surface 46 is substantially parallel to the bottom wall 58 and the rounded end 52 rests against a corner defined between the wall 38 and the bottom wall 58. As in the above embodiments, pressure on the wall 38 to move the push piece 36 will further tilt the arm 42, against the elastic force exerted by the section 60, thereby to release the engagement of the latch tongues 22 and 24.

Figure 10:
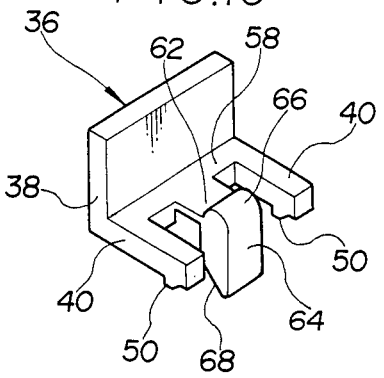
FIG. 10 is a perspective view of a push piece of a vanity case according to a fourth embodiment of the present invention.
Figure 11:
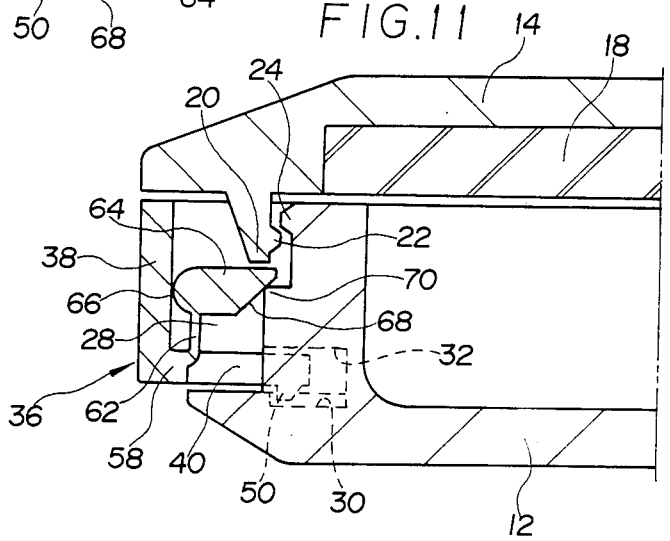
FIG. 11 is a fragmentary sectional view showing a vanity case of the fourth embodiment, with the push piece being in a normal position.
Figure 12:
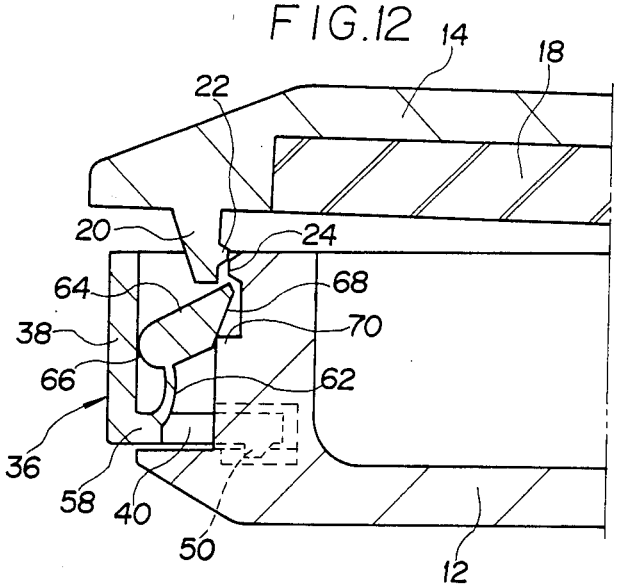
FIG. 12 is a view similar to FIG. 11 but with the push piece being in an active position.

The arm of the push piece 36 may be in other shapes and one of the modifications thereof is shown in FIGS. 10 to 12. In this fourth embodiment of the present invention, a thin flexible section 62 extends rearwardly from the upper surface of the bottom wall 58 for integral connection with the arm which comprises a head piece 64. The head piece 64 has a rounded end 66 as in the third embodiment and a tapered end including a slanted surface 68 formed at the inner side of the head piece 64. In an assembled status shown in FIG. 11, the section 62 is raised at a substantially right angle with respect to the bottom wall 58 so that the outer surface of the head piece 64 extends in a horizontal direction with the rounded end 66 abutting against the wall 38. The slanted surface 68 extending upwardly toward the rear end rests against an upper edge of a shelf 70 which constitutes a part of the inner wall 26 and projects toward the vertical wall 38 of the push piece 36. The upper surface of the head piece 64 is closely adjacent to the lower end of the projection 20 when the push piece 36 is held in the normal position and, upon rearward movement of the piece 36, is tilted to press the projection 20 with the slanted surface 68 sliding on the shelf 70 as shown in FIG. 12.

Instead of the provision of the slanted surface 68 on the head piece 64, the shelf 70 may be provided with a surface portion inclined in the same direction as that of the surface 68, against which a rear edge of the head piece 64 rests. Alternatively, both of the head piece 64 and the shelf 70 may include slanted surfaces for contact with each other.

Figure 13:
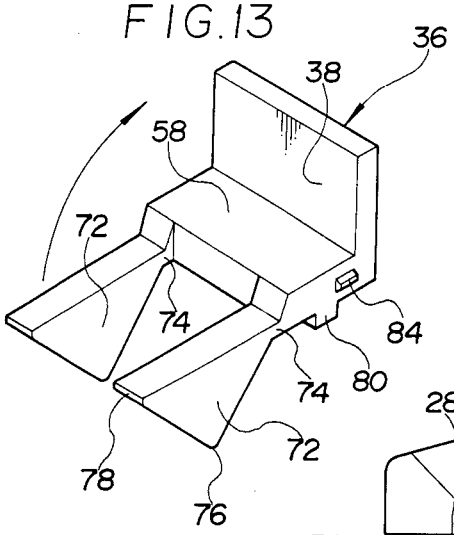
FIGS. 13 to 15 are views similar to FIGS. 10 to 12, respectively, showing a vanity case according to a fifth embodiment of the present invention.

Illustrated in FIG. 13 is the push piece 36 according to the fifth embodiment of the invention, in which a pair of arms each comprising a substantially triangular piece 72 are integrally secured to the bottom wall 58 through thin, flexible sections 74 provided at the opposite sides of the outer or rear end of the bottom wall 58. Each triangular piece 72 extends rearwardly and includes a corner 76 constituting the lower end thereof, while a plane extending between the section 74 and an outer end 78 of the piece 72 is parallel with the bottom wall 58. A projection 80 is formed across the lower surface of the bottom wall 58 to slidably engage with a first groove 82 of the receptacle 12, and pawls 84 are provided on the opposite side surfaces of the bottom wall 58 also for slidable engagement with second grooves 86 formed on the side walls defining the recess 28.

Figure 14:
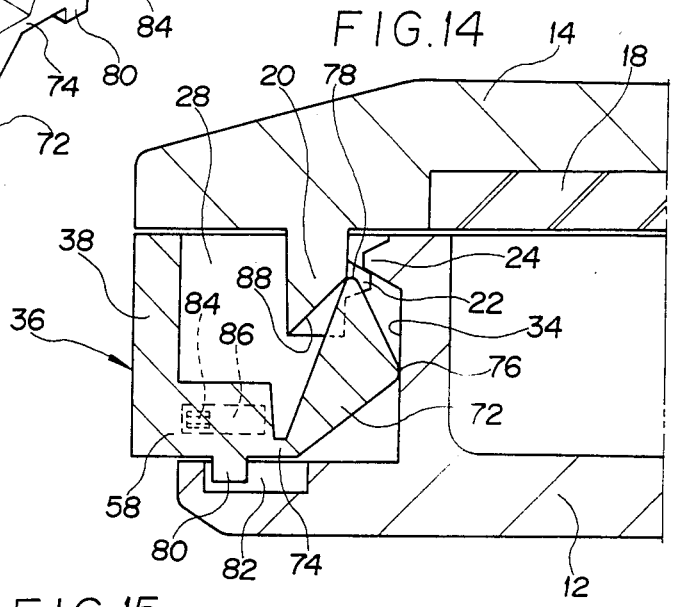
Figure 15:
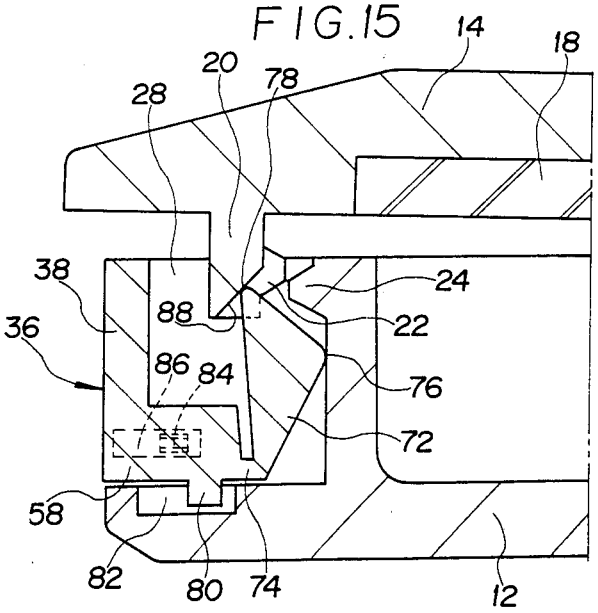

As noted from FIG. 14, when the push piece 36 is mounted in the recess 28 with the triangular pieces 72 being maintained in a raised position, corners 76 are in pressing contact with the vertical surface 34, and the ends 78 contact slanted surfaces 88 formed on the lower end of the projection 20. It should be understood from the drawings that the slant surfaces 88 are formed at opposite side ends of the projection 20 corresponding to the triangular pieces 72 and adjacent to the first latch tongue 22 provided centrally of the projection 20. Upon rearward movement of the push piece 36 the corners 76 slide upwardly on the vertical surface 34, resulting in a further tilting of the triangular pieces 72 thereby to press the projection 20 upwardly and forwardly by the ends 78 for releasing the engagement of the latch tongues 22 and 24, as shown in FIG. 15.

Figure 16:
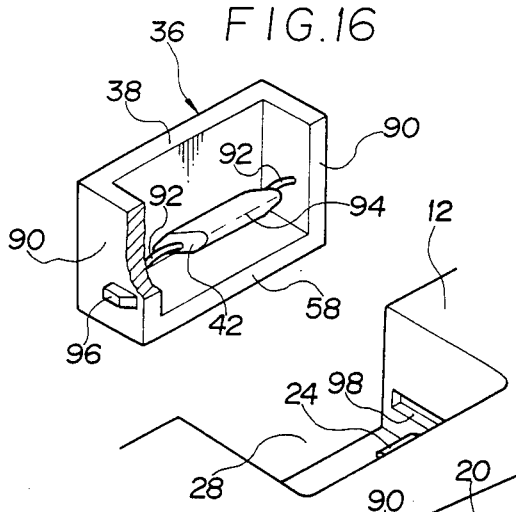
FIG. 16 is a partially sectioned perspective view illustrating a recess and a push piece of a vanity case according to a sixth embodiment of the present invention.
Figure 17:
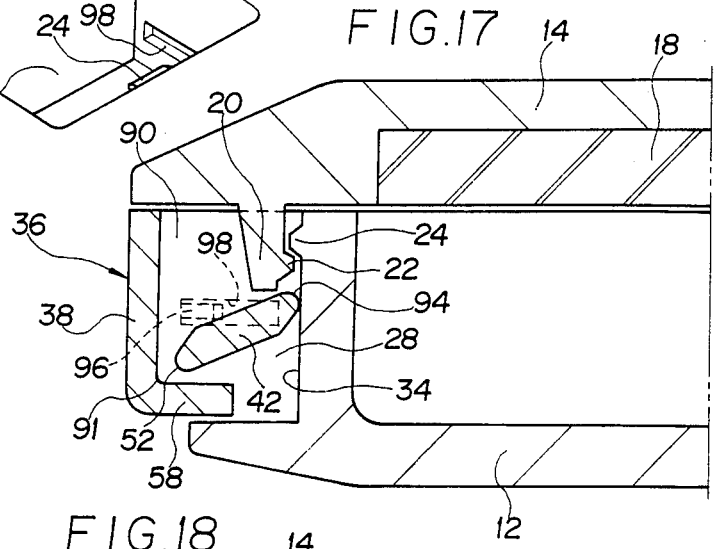
FIGS. 17 and 18 are views similar to FIGS. 11 and 12, respectively, showing a vanity case of the sixth embodiment.
Figure 18:
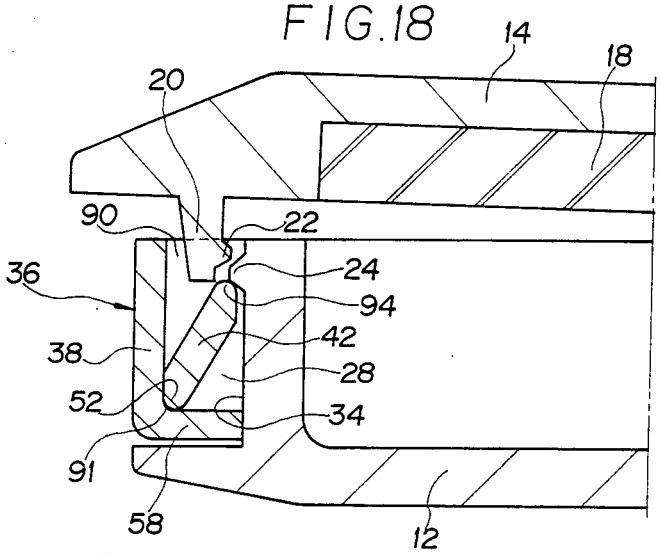

The push piece 36 according to a sixth embodiment of the invention is illustrated in FIGS. 16 to 18 to include opposite side walls 90 extending from the bottom wall 58 perpendicularly to the front wall 38. From the inner surfaces of the side walls 90 extend flexible pieces 92 in the form of straps integrally connected to the tilt arm 42 for holding the latter within a space defined by the front, bottom and side walls 38, 58 and 90. The rounded end 52 of the arm 42 faces a corner 91 between the front wall 38 and the bottom wall 58, while an outer end 94 extends beyond the space in the push piece 36 to reach the vertical surface 34 when the push piece 36 is mounted in the recess 28. Pawls 96 are provided on the outer surfaces of the side walls 90 for engagement with grooves 98 on the side walls of the recess 28 in order to secure the piece 36 therein in the slidable manner. Backward movement of the piece 36 causes the rounded end 52 of the arm 42 to come into contact with the corner 91 while bending the flexible pieces 92, whereby the arm 42 is urged rearwardly. Then, the outer end 94 slides on the vertical surface 34 upwardly to press the projection 20 as seen from FIG. 18.

It will be apparent that the advantages described in connection with the first embodiment also may be obtained in any of the above other embodiments. Thus, the engagement of the latch tongues 22 and 24 can be released with small force by pushing the front wall 38 of the push piece 36 rearwardly. After the engagement is released, the cover 14 may be opened to any desired angle by lifting the front edge thereof which is at that time away from the push piece 36 by a distance sufficient to permit a user to put her finger on the lower surface of the cover 14. The push pieces are one-piece molds of plastic material and may be held in their normal, frontmost position by the flexibility or elasticity of the thin section.

Although the present invention has been described with reference to the preferred embodiments thereof, many modifications and alterations may be made within the spirit of the invention.

What is claimed is:

1. A vanity case comprising:

a receptacle member molded of plastic material for containing cosmetic material;

a cover member molded of plastic material;

said receptacle and cover members being hinged together at respective rear ends thereof;

a recess formed in a front end of said receptacle member and defined by an inner wall, a bottom surface and side walls;

a first latch tongue formed on said cover member;

a second latch tongue formed on said inner wall of said recess;

said first and second latch tongues being engaged with each other by snap action when said receptacle member is closed by said cover member, thereby maintaining sand cover member in a closed position with respect to said receptacle member; and a push piece disposed within said recess and being movable therein rearwardly and forwardly, said push piece having a front wall and an arm integrally formed with said front wall through a thin flexible section, said flexible section permitting said arm to tilt with respect to said front wall, an upper surface of said arm being positioned closely adjacent a lower surface of said cover member in said closed position of said cover member, and a rear end of said arm being in contact with said inner wall of said recess and, upon rearward movement of said push piece, sliding upwardly on said inner wall to tilt said arm whereby said upper surface of said arm forces said lower surface of said cover member in upward and forward directions to release engagement between said first second latch tongues.

2. A vanity case as claimed in claim 1, wherein said arm has a substantially rectangular shape and is normally inclined upwardly toward said rear end thereof with said flexible section being in a bent status.

3. A vanity case as claimed in claim 2, wherein said upper surface of said arm includes a surface so inclined relative to the longitudinal axis of said arm as to extend parallel to said lower surface of said cover member.

4. A vanity case as claimed in claim 2, wherein said flexible section extends rearwardly from a lower end of said front wall.

5. A vanity case as claimed in claim 4, wherein an outer end of said flexible section is integrally joined to a front end of said arm.

6. A vanity case as claimed in claim 4, wherein said arm includes a rounded front end having formed therein a cavity into which said flexible section extends, said rounded front end resting against a corner defined between said front wall of said push piece and said bottom surface of said recess.

7. A vanity case as claimed in claim 2, wherein said push piece has a bottom wall extending perpendicularly to said front wall, said flexible section extending from an end surface of said bottom wall to a lower surface of said arm, and said arm includes a rounded front end which rests against a corner defined between said front wall and said bottom wall.

8. A vanity case is claimed in claim 1, wherein said arm comprises a head piece having a rounded front end, said rounded front end being in contact with an inner surface of said front wall, and said inner wall of said recess includes a shelf with which a rear end of said head piece is in contact, at least one of said shelf and said rear end having a slanted surface adapted to cause said rear end to slide on said shelf upwardly by said rearward movement of said push piece.

9. A vanity case as claimed in claim 8, wherein said push piece includes a bottom wall, said flexible section extending in upright status from an end surface of said bottom wall to a lower surface of said head piece.

10. A vanity case as claimed in claim 1, wherein said push piece includes a bottom wall and said arm comprises a triangular piece, said flexible section integrally connecting a front end of said triangular piece to an end surface of said bottom wall.

11. A vanity case as claimed in claim 10, wherein said lower surface of said cover member has a slanted portion to which said upper surface of said triangular piece is closely adjacent.

12. A vanity case as claimed in claim 10, wherein a pair of said triangular pieces are formed separately from each other.

13. A vanity case as claimed in claim 12, wherein said bottom wall of said push piece has a projection formed on a lower surface thereof and pawls provided on opposite side surfaces thereof, said projection and said pawls being slidably engaged with a first groove in said bottom surface and second grooves of said side walls of said recess, respectively.

14. A vanity case as claimed in claim 1, wherein said push piece includes a bottom wall extending perpendicularly to said front wall and opposite side walls to define a space therebetween, said flexible section comprises a pair of flexible pieces each extending from an inner surface of the respective said side wall to said arm thereby to secure said arm in said space.

15. A vanity case as claimed in claim 14, wherein said arm has a rounded front end which normally faces a corner defined between said front and bottom walls of said push piece and, upon said rearward movement of said push piece, comes into contact with said corner for moving together while bending said flexible pieces.

16. A vanity case as claimed in claim 14, wherein said said walls of said push piece have formed on outer surfaces thereof pawls which are slidably engaged with grooves formed on said side walls of said recess.

17. A vanity case as claimed in claim 1, wherein said push piece further comprises a pair of guide arms extending rearwardly from opposite sides of a lower end of said front wall, and said recess of said receptacle member includes a pair of guide holes formed in a lower end of said inner wall for receiving therein end portions of said guide arms.

18. A vanity case as claimed in claim 17, wherein each said guide arm has formed on a lower surface thereof a projection slidably engaged with a groove formed in said bottom surface of said recess.

19. A vanity case as claimed in claim 1, wherein said lower surface of said cover member includes a projection on which said first latch tongue is formed, said upper surface of said arm being closely adjacent a lower end of said projection in said closed position of said cover member.

20. A vanity case as claimed in claim 19, wherein said projection has a pair of slanted surfaces separate from each other and said first latch tongue is formed between said slanted surfaces.

* * * * *